US006502370B2

(12) United States Patent
Martelli

(10) Patent No.: US 6,502,370 B2
(45) Date of Patent: Jan. 7, 2003

(54) METHOD FOR MANUFACTURING A PACKAGE FOR PACKAGING FOOD PRODUCTS AND APPARATUS FOR EXECUTING THE METHOD

(76) Inventor: Guglielmo Martelli, Via Gaibola, 13/3, 40136 Bologna (IT)

( * ) Notice: Subject to any disclaimer, the term of this patent is extended or adjusted under 35 U.S.C. 154(b) by 0 days.

(21) Appl. No.: 09/919,884

(22) Filed: Aug. 2, 2001

(65) Prior Publication Data

US 2002/0029545 A1 Mar. 14, 2002

(30) Foreign Application Priority Data

Aug. 3, 2000 (IT) ..... BO00A0483

(51) Int. Cl.[7] ..... B65B 11/58

(52) U.S. Cl. ..... 53/449; 53/465; 53/466; 53/176; 53/225; 53/389.3; 53/389.4

(58) Field of Search ..... 53/449, 465, 466, 53/176, 225, 389.3, 389.4

(56) References Cited

U.S. PATENT DOCUMENTS 2,043,830 A 6/1936 Grant et al.
3,660,958 A * 5/1972 Garrison ..... 53/449
4,209,956 A * 7/1980 Clayson et al. ..... 53/389.3
4,494,741 A 1/1985 Fischer et al.
4,726,169 A * 2/1988 Achelpohl et al. ..... 53/449
5,390,470 A * 2/1995 Brunini et al. ..... 53/389.3
5,954,914 A 9/1999 Aihara

FOREIGN PATENT DOCUMENTS

GB 269 618 4/1927

* cited by examiner

*Primary Examiner*—Ted Kavanaugh
(74) *Attorney, Agent, or Firm*—Guido Modiano; Albert Josif; Daniel O'Byrne

(57) ABSTRACT

A method for manufacturing a package for packaging food products, composed of an outer sheet made of heat-sealable material and of an undulated inner sheet. In a first step of the method, the two sheets are unwound from respective reels, so that the outer sheet forms two lateral borders left exposed by the inner sheet. By way of appropriate longitudinal movements of the sheets, the inner sheet is centered on the outer sheet so as to form, at their opposite ends, two transverse borders which are perpendicular to the lateral ones.

10 Claims, 7 Drawing Sheets

28
33
27
5
35
32
6
36
25
37
34
56
38
58
39
55
40
26
57
42
54
46
41
51
63
60
45
50
52
53
47
44
43
23
88
82
80
28
79
93
23
49
74
48
22
76
21
96
92
91
14
15
13
19
17
18
20
87

METHOD FOR MANUFACTURING A PACKAGE FOR PACKAGING FOOD PRODUCTS AND APPARATUS FOR EXECUTING THE METHOD

BACKGROUND OF THE INVENTION

The present invention relates to a method for manufacturing a package for packaging food products and to an apparatus for executing the method.

In conventional packagings of food products, particularly biscuits or crispbread slices arranged in a stack so as to form a pack, the enclosure is constituted by a package composed of an outer sheet of heat-sealable material and of an inner sheet made of paper-like material. The inner sheet has a smooth face and a corrugated (undulated) face comprising a plurality of small parallel folds having a sinusoidal orientation.

Within current packaging methods, the inner sheet is wrapped around the products so that the undulated face remains in contact with the products and the smooth face is in contact with the heat-sealable sheet, which wraps around it and covers it externally.

The package is closed by mating and mutually heat-sealing two border flaps of the outer sheet. Clearly, if the sheets are obtained by cropping films unwound from reels, in order to allow the border flaps of the outer sheet to make contact with each other in order to be heat-sealed together, the portion of the inner sheet that would otherwise become interposed between the two overlapping flaps of the outer sheet must be removed beforehand.

In any case, with known methods there are heat-sealing problems, since the pressure required to join the flaps of the outer sheet is applied against the product and cannot exceed certain limits in order to avoid damage to the product; moreover, the irregularities of the product produce an irregular heat-sealing line, in that loosely heat-sealed regions can be interposed between regions where the heat seal is scarcely reliable.

The looseness of the heat seal can make the packaging permeable to external agents and can compromise the integrity of the contained product.

SUMMARY OF THE INVENTION

The aim of the present invention is to provide a newly conceived method that allows to obviate the above noted drawbacks in the packaging of products in an enclosure constituted by a package composed of a heat-sealable outer sheet and of an inner sheet which has a smooth face and an undulated face.

In particular, the method must be able to ensure the hermetic tightness of the packaging without damaging the products even in the case of delicate products.

This aim is achieved with a method for manufacturing a package for packaging food products composed of an outer sheet made of heat-sealable material and of an inner sheet which has a smooth face in contact with said outer sheet and an undulated face, said sheets being cut from two respective outer and inner films unwound from reels, said outer film being wider than said inner film transversely to the unwinding direction, said method being characterized in that it comprises the steps of:

coupling said inner film to said outer film so as to form two lateral borders of said outer film left exposed by said inner film;

unwinding a length of said films from said reels;

making one film slide with respect to the other, parallel to said lateral borders, up to a staggered position, in which said inner film leaves exposed an end portion of said outer film which has a preset height and is perpendicular to said lateral borders;

cropping both films in said staggered position, so as to form said outer and inner sheets having two borders which are superimposed and two borders in which the inner sheet border leaves exposed said end portion of said outer film;

moving one sheet with respect to the other by an extent which is smaller than the height of said end portion, so as to form a package in which the inner sheet is centered on the outer sheet, so as to form two transverse borders which are lower than said end portion.

Within this aim, an object of the present invention is to provide an apparatus for executing the method whose characteristics are defined in the appended claims.

Another object of the present invention is to provide an apparatus that can be used in conventional packaging machines affected by the problem of insufficient hermetic closure of the packagings.

BRIEF DESCRIPTION OF THE DRAWINGS

Further characteristics and advantages of the invention will become better apparent from the following description of a machine for packaging products which incorporates the apparatus according to the invention, illustrated only by way of non-limitative example in the accompanying drawings, wherein.

DESCRIPTION OF THE PREFERRED EMBODIMENTS

Figure 1:
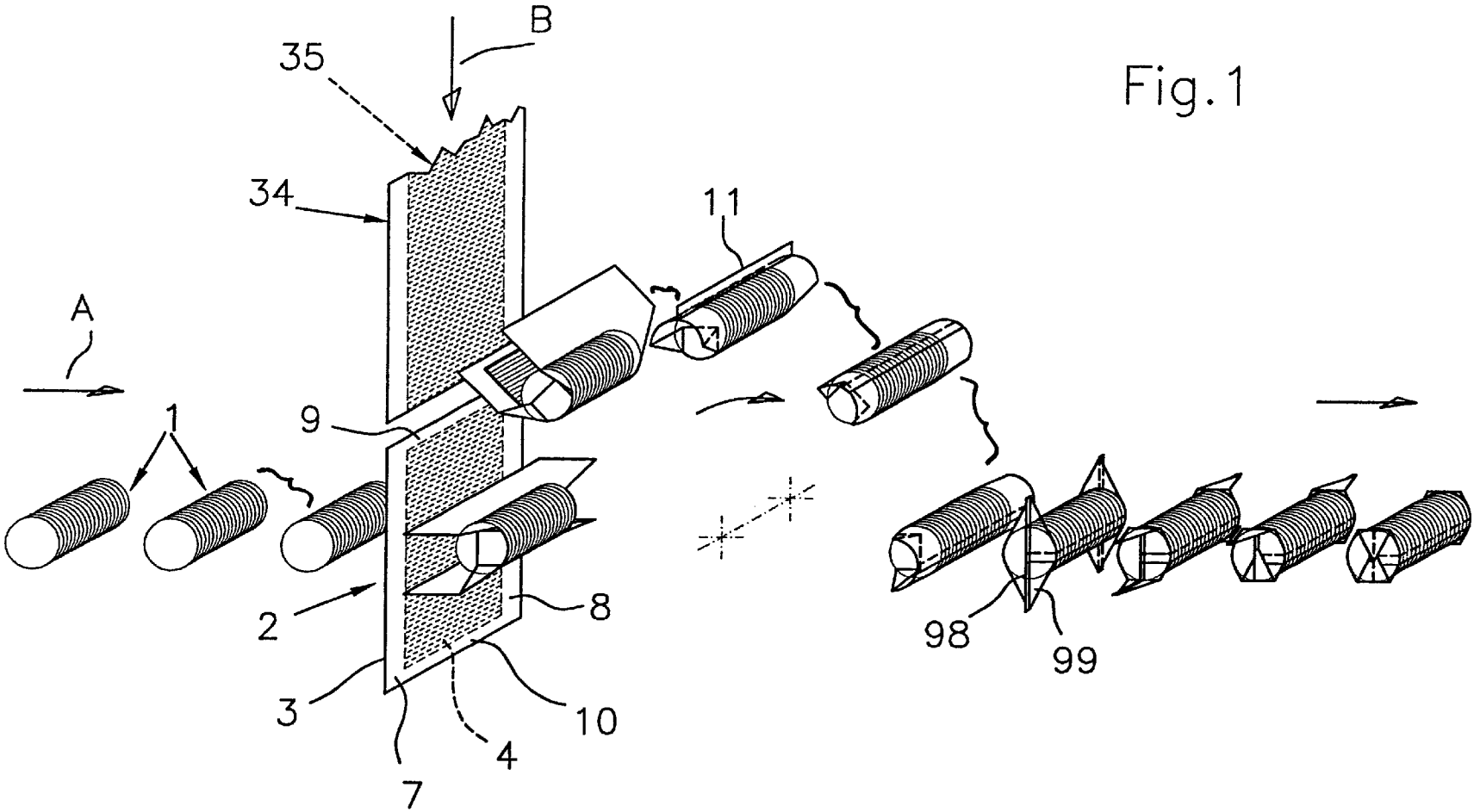
FIG. 1 is an exemplifying diagram of the method.
Figure 2:
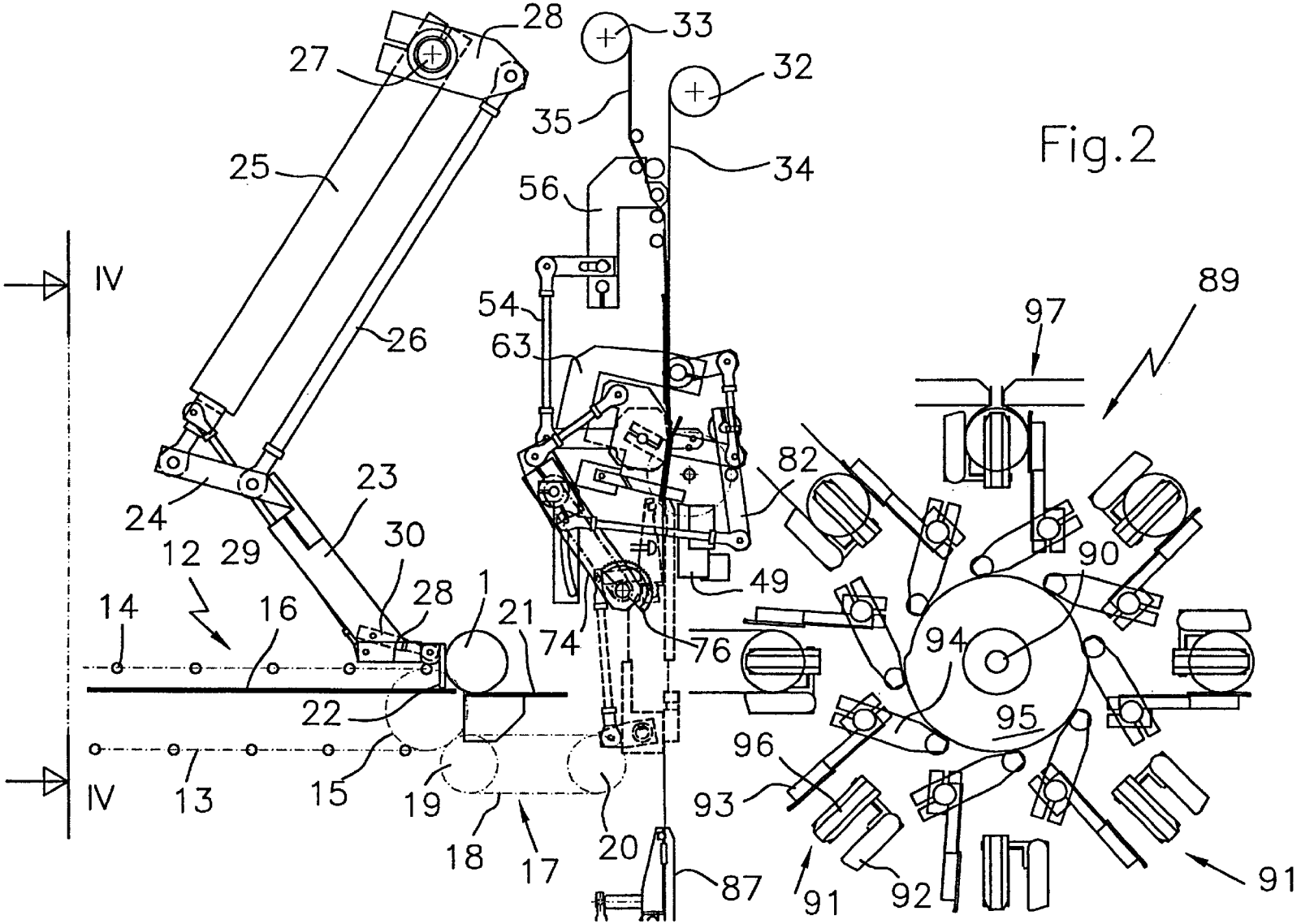
FIG. 2 is a schematic side elevation view of the machine.

With reference to FIGS. 1 and 2, in order to better clarify the structure and operation of the machine, a brief description is given of the method for packaging products 1 which in the specific case are biscuits or crispbread slices having a circular shape, which are gathered in cylindrical packs having parallel axes, are mutually equidistant and lie on a horizontal plane. The products may of course have any shape.

The products 1 are conveyed by a conveyor 12 (see FIG. 2) which is actuated so as to move intermittently in the direction A, so that each product is capable of affecting a corresponding package 2 arranged in front of it on a vertical plane.

The package 2 is a two-part sheet constituted by a first rectangular sheet 3 made of heat-sealable material and by a second sheet 4 made of paper-like material, which is coupled to the first sheet on the side that faces the incoming products. With reference to the final position assumed by the sheets 3 and 4 on the product, the sheet 3 is referenced hereinafter as outer sheet and the sheet 4 is referenced as inner sheet. The sheets 3 and 4 are cropped from films 34, 35 which are taken from respective reels 32, 33 and are fed from above in the direction B at right angles to the direction A.

Figure 3:
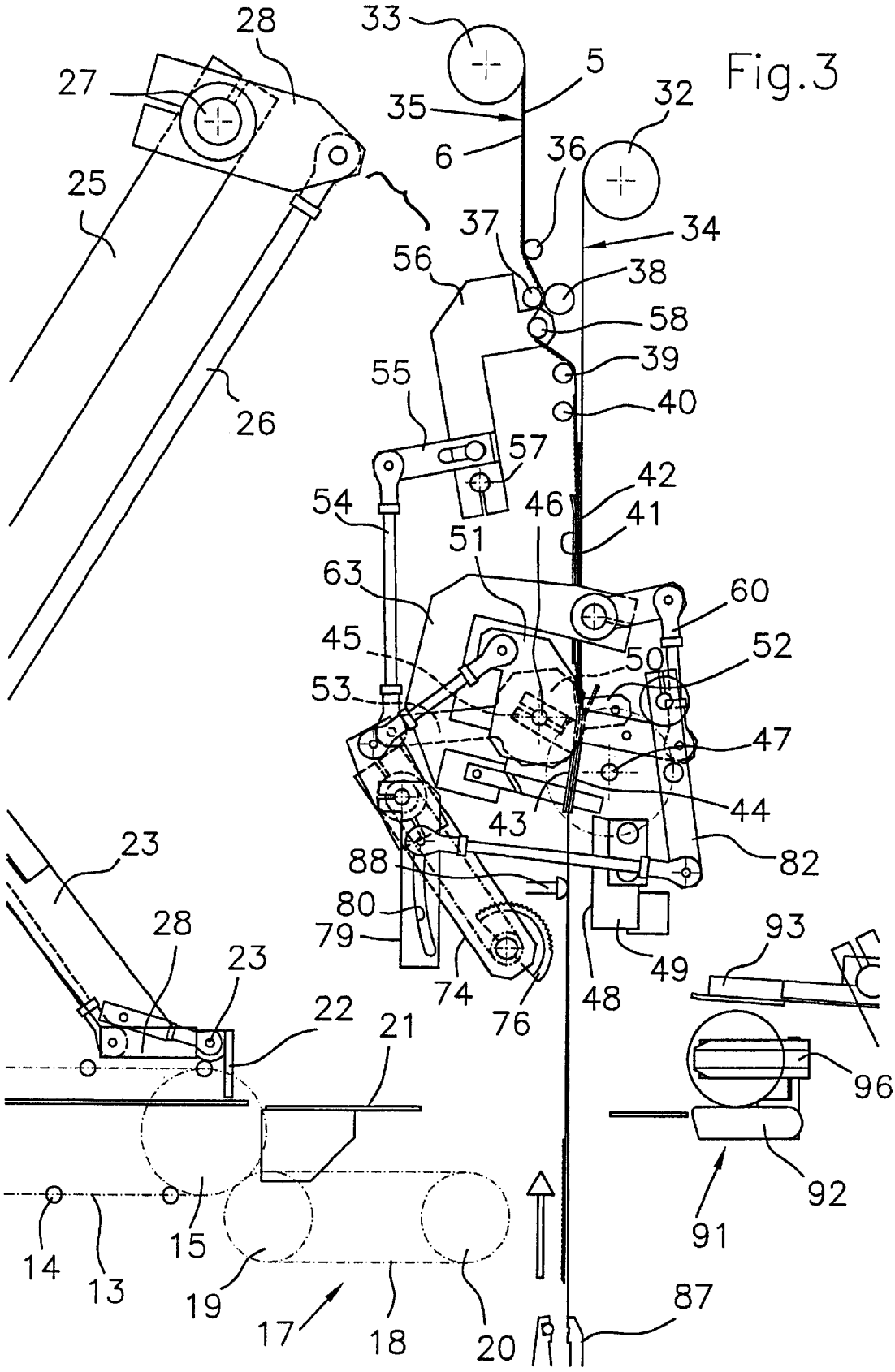
FIG. 3 is an enlarged-scale view of the central part of the machine shown in FIG. 1, related to the apparatus preset for centering the inner sheet with respect to the outer sheet of the package.

As shown more clearly in FIG. 3, the film 35 comprises a smooth face 5, which is designed to remain in contact with the film 34, and a face 6, which has corrugations or undulations consisting in sinusoidal folds which are parallel to the horizontal axes of the products 1.

The inner sheet 4 has a length, in the direction B, and a width, at right angles to the direction B, which are respectively equal to the circumference and length of the packs 1. Moreover, said width and length of the inner sheet 4 are smaller than those of the outer sheet 3, so that two vertical lateral borders 7, 8 and two upper and lower horizontal borders 9, 10 remain perimetrically exposed on the outer sheet once centering has been performed. The inner sheet 4 is cut and centered on the sheet 3 so as to form the borders 7–10 by means of a centering and positioning apparatus, which is generally designated by the reference numeral 31 and constitutes the inventive concept of the present invention. As the products 1 advance in the direction A, the package 2, by means of appropriate folding elements, is folded in a U-like shape in a first step, forming two flaps which are superimposed parallel to each other. The products 1 are then transferred in succession between the jaws of respective clamps 91 (see FIG. 2) which are mounted on a carousel 89 and are provided with folding units which fold the central portions of the lateral borders 7, 8 on the opposite ends or heads of the products 1. Then the two flaps of the package 2 are folded onto the surface of the products and the two upper and lower borders 9 and 10 are mutually heat-sealed so as to close the package and form a tubular enclosure provided with a wing 11 which protrudes radially from the product.

After folding the wing 11 onto the enclosure, the products 1, at the end of a 360° rotation of the carousel 89, are delivered by the clamps to means which turn outward again the central portions of the lateral borders 7 and 8 and then close the enclosure by heat-sealing said borders and folding the ends of the enclosure onto the heads of the products.

Figure 4:
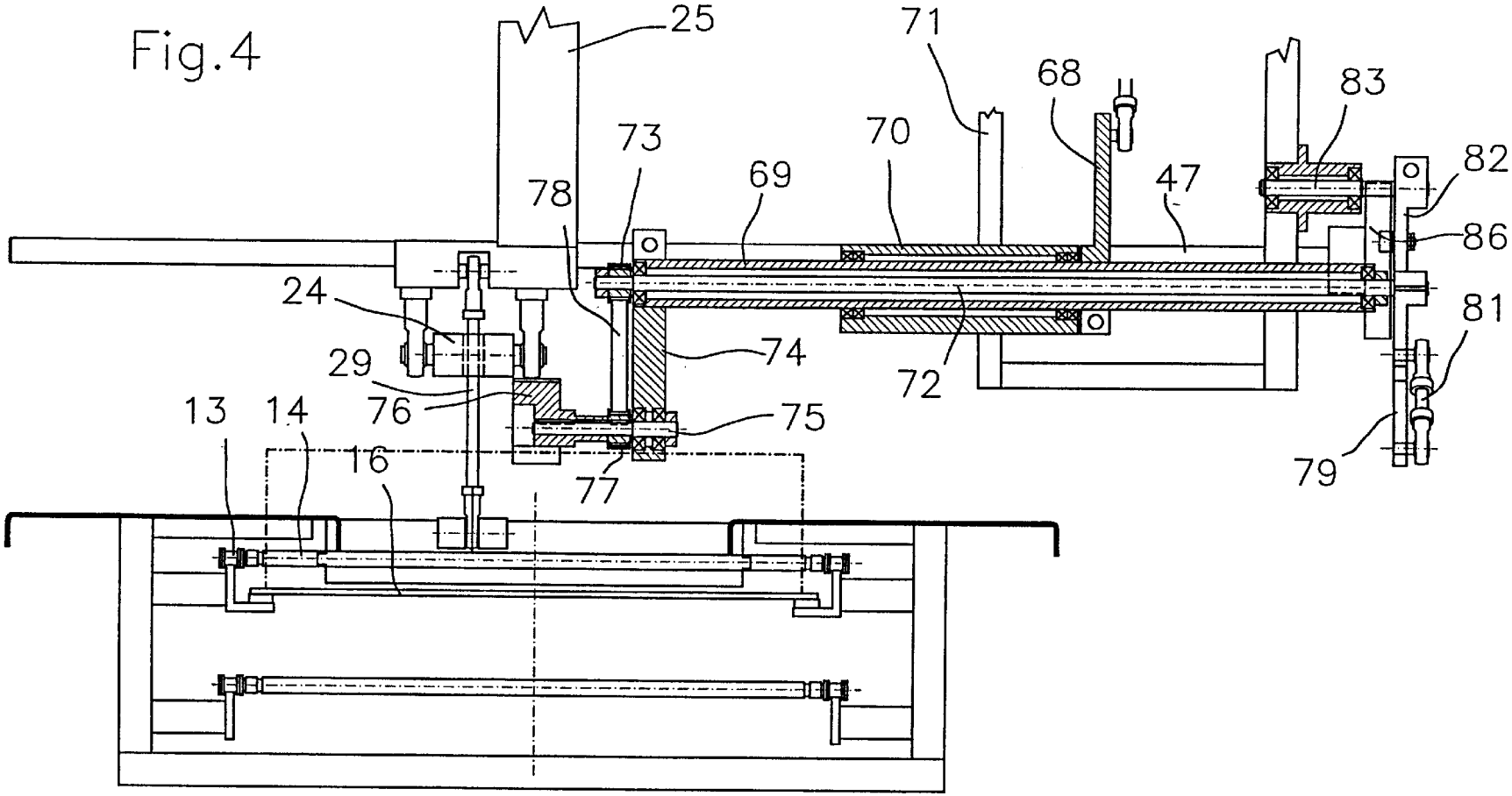
FIG. 4 is a sectional view, taken along the plane IV—IV of FIG. 2.

With particular reference to FIGS. 2 and 4, the reference numeral 12 generally designates the conveyor of the products 1, which is composed of two mutually parallel chains 13 connected by equidistant bars 14. The chains 13 are wound around sprockets; only the downstream sprockets, designated by the reference numeral 15, are shown in the figure. The upper portion of the chains 13 moves horizontally and intermittently in the direction A and pushes the products 1 on a sliding surface 16.

At the exit of the conveyor 12 there is a transfer unit 17 composed of a chain 18, which is closed in a loop on respective sprockets 19 and 20. A pan 21 is fixed to the upper portion of the chain 18, is co-planar to the plane 16, and is provided with side walls in order to laterally support the products. The chain 18 is actuated with a reciprocating motion between a retracted position, in which the pan 21 is adjacent to the plane 16 in order to receive the products 1 from the conveyor 12, and an advanced position for supporting the products during the initial step of forming the packaging. In order to push the products against the package 2, there is a pusher 22 which is supported articulately at the lower end of an arm 23.

The arm 23 has, at its top, an oblique protrusion 24 to which the lower ends of two parallel bars 25, 26 are articulated. The upper end of the bar 25 is keyed to a shaft 27 which is actuated with an oscillating motion, while the bar 26 is articulated to a lever 28 which is pivoted to the shaft 27. In this manner, the protrusion 24, the bars 25 and 26 and the lever 28 form an articulated parallelogram which oscillates about the shaft 27.

The pusher 22 is provided with a tang **28*a* which, by means of a rod 29, is connected to the bar 25 proximate to the point of articulation to the protrusion 24. Moreover, the pusher 22 is connected to the end of the arm 23, by means of a traction element 30. The arrangement of the fulcrums of the rod 29 and of the traction element 30 is chosen so that when the oscillation of the shaft 27 occurs in the advancement direction A of the pusher 22, said pusher advances so as to remain substantially at the same level and at right angles to the pan 21**.

Downstream of the transfer unit 17 there is an apparatus 31 meant to crop the sheets 3 and 4 from the films 34, 35 and to center the inner sheet with respect to the outer sheet. The apparatus 31 comprises means for supporting two reels 32 and 33: the reel 32 contains the film 34 from which the heat-sealable sheet 3 is obtained, and the reel 33 contains the film 35 from which the undulated sheet 4 is obtained. The films 34 and 35 are unwound downward in the direction B. In particular, the sheet 35 passes, after being diverted by a roller 36 (see FIG. 3), between two stationary rollers 37 and 38. Under the rollers 37 and 38 there are two additional stacked rollers 39 and 40, which guide the film 35 in an interspace formed between two vertical walls 41 and 42. The rollers 36, 38 are in tangential contact with the smooth face 5 of the film 35, while the rollers 37, 39, 40 are in contact with the undulated face 6. It should be noted that the film 34 does not pass between the walls 41 and 42 but is guided on the outer face of the wall 42.

Two additional walls 43, 44 are arranged at the exit region of the walls 41 and 42 so as to be substantially vertically aligned with them; said additional walls are termed plates hereinafter, and their upper borders are divaricated so as to form a guide for the insertion of the films 34 and 35 between them. The plates 43, 44, by means of a clamp 45, are rigidly rotationally coupled to a shaft 46, which is supported so as to be rotatable about a horizontal axis.

The shaft 46 is controlled by a first radial cam (not shown) keyed on a timing shaft 47. The cam actuates the rotation of the shaft 46 so as to impart to the walls 43, 44 an oscillating motion, by virtue of which the two films 34, 35 at the exit of the interspace formed by the plates 43, 44 are placed in contact with a vertical wall 48 of a block 49 which is fixed under the shaft 47.

Two additional levers 50, 51 are rotatably mounted on the shaft 46. The lever 50 has two arms 52 and 53 which are arranged diametrically. By means of the arm 52, the lever 50 is controlled by a second cam (not shown), which is keyed on the timing shaft 47. The second arm 53 of the lever 50 is articulately connected, by means of a traction element 54, to a secondary arm 55 which is fixed to one of two L-shaped brackets 56 fixed onto a shaft 57 which is supported so that it can rotate parallel to the shaft 47.

The two brackets 56 have, at their ends, a roller 58, which is parallel to the shaft 57 and is arranged between the films 34, 35. More particularly, the roller 58 is arranged between the upper rollers 37, 38 and the lower roller 39 and is in tangential contact with the smooth face of the undulated film 35. The actuation imparted by the second cam to the lever 50 causes an oscillation of the roller 58 which forces the film 35 to follow a zigzag pattern whose purpose will become better apparent hereinafter.

Figure 5:
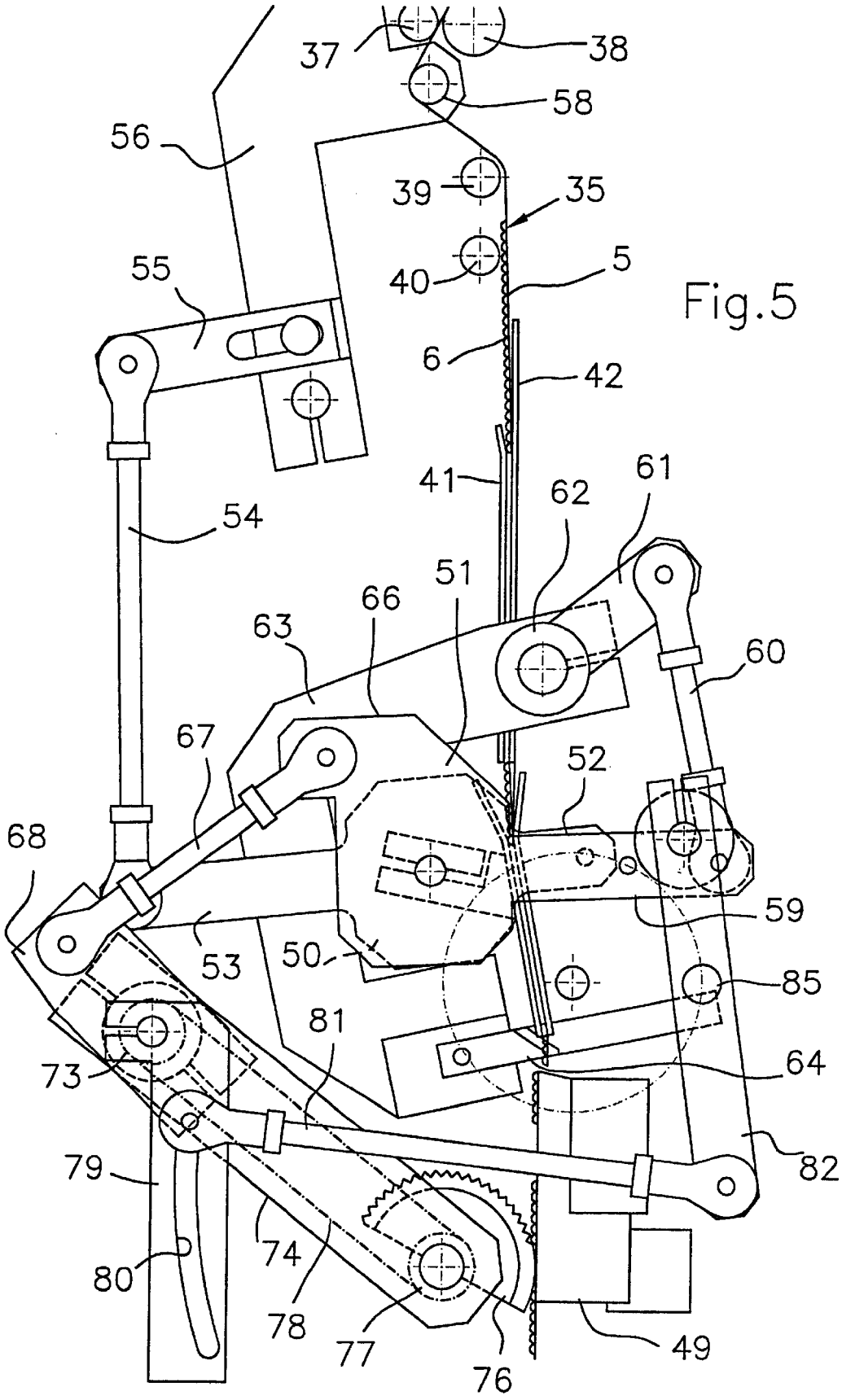
FIGS. 5 and 6 are views of two successive operating positions of the machine.
Figure 6:
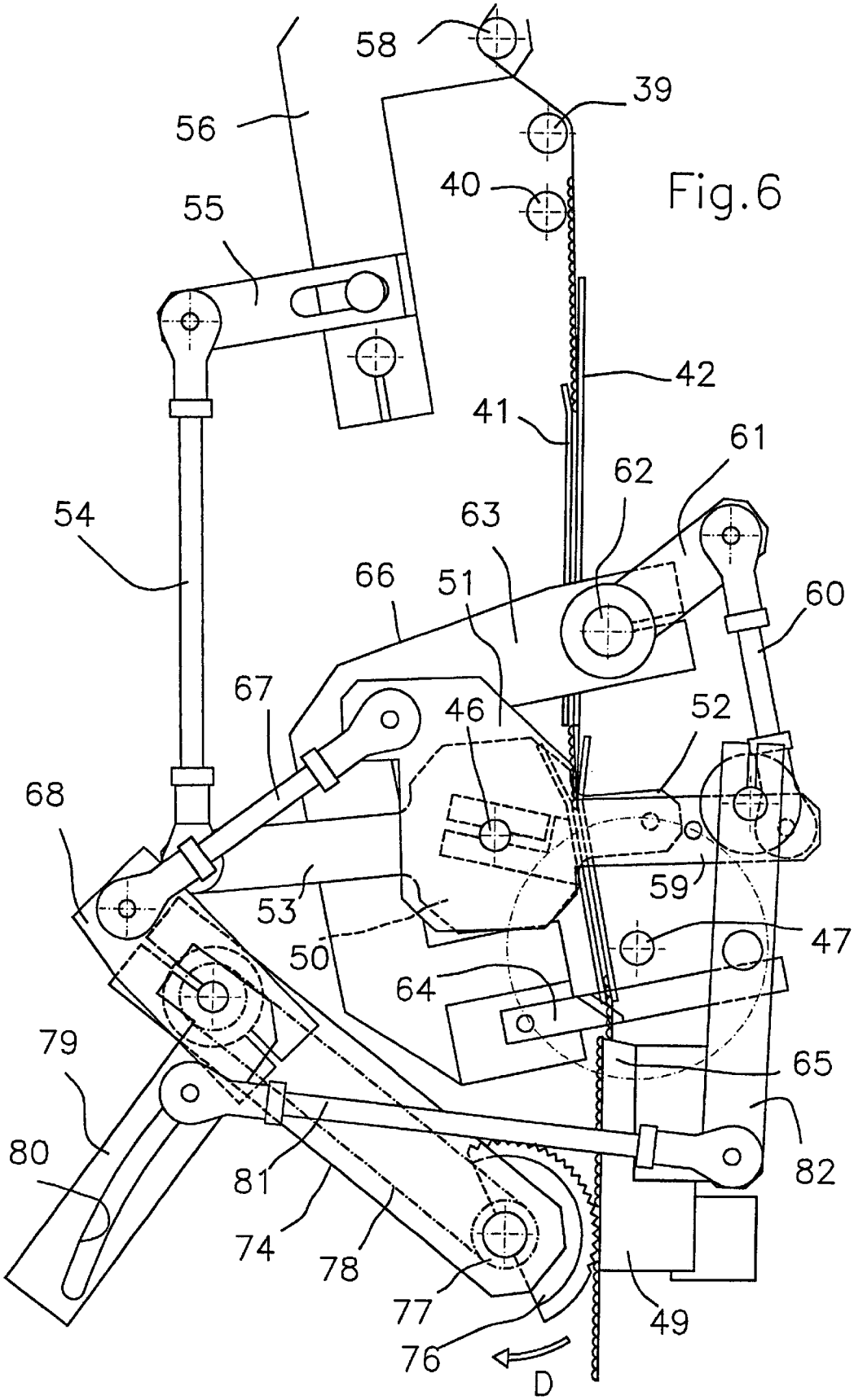

The lever 51 (see also FIGS. 5 and 6) has a radial arm 59, which is controlled by a third cam (not shown) keyed onto the shaft 47. One end of a traction element 60 is articulately connected to the end of the arm 59; the opposite end of the traction element is articulated to the end of a secondary arm 61, which is radially rigidly coupled to a shaft 62 supported so that it can rotate parallel to the shaft 47.

Two substantially C-shaped elements 63 are rigidly coupled to the shaft 62 and lie outside the opposite ends of the walls 41, 42 and of the plates 43, 44. The elements 61 surround the shaft 46 and a blade 64 is fixed between their ends arranged under the shaft 46, in order to cut the films 34, 35 into portions that constitute the sheets 3 and 4 of the package 2. The blade 64 acts in a scissor-like fashion on the films 34, 35 in cooperation with a cutting corner 65 formed on the block 49 at the top of the wall 48.

The lever 51 for actuating the blade 64 has, in a diametrically opposite position with respect to the secondary arm 59, an expansion 66 to which an additional traction element 67 is pivoted; the traction element connects the lever 51 to a first arm 68 fixed on a hollow shaft 69 (see FIG. 4) which is parallel to the timing shaft 47. The hollow shaft 69 can rotate in a sleeve 70, which is rigidly coupled to the frame 71 of the machine. A shaft 72 is rotatably supported inside the hollow shaft 69 and has a portion that protrudes from the hollow shaft. A toothed pulley 73 is keyed onto said protruding portion. The toothed pulley 73 is adjacent to an end of the hollow shaft on which a second radial arm 74 is fixed; said radial arm protrudes in a direction which is substantially opposite to the direction of the first arm 68.

The arm 74 rotatably supports, in a cantilevered manner, a pivot 75 on which a toothed sector 76 and a toothed pulley 77, co-planar to the pulley 73, are keyed. A toothed belt 78 is closed in a loop around the pulleys 73, 77.

The lever 79 is keyed to the end of the inner shaft 72 that lies opposite the pulley 73, and an arc-like slot 80 is formed in a substantially radial direction in said lever.

The end of a traction element 81 is fixed in the slot 80, and its opposite end is pivoted to a radial lever 82, which is in turn rigidly coupled to a pivot 83 rotatably supported in a sleeve 84 mounted in a cantilevered fashion on the frame 71.

The lever 82, by means of a central roller 85, is controlled by an additional cam 86, which is keyed on the timing shaft 47.

From the above description it is thus evident that by way of the rotation of the timing shaft 47, the cam for actuating the lever 51, by means of the traction element 67 and the arm 68, causes the rotation of the hollow shaft 69 and the oscillation of the arm 74, so as to move the toothed sector 76 toward the wall 48 of the block 49, while the cam 86, which actuates the lever 82, by means of the traction element 81 and the lever 79, causes the rotation of the inner shaft 72 and, by means of the belt transmission 74, of the toothed sector 76. The actuation of the toothed sector 76 is timed with respect to the oscillation of the arm 74, so as to turn the toothed sector 76 in the direction D (which matches the unwinding direction) when the sector 76 is adjacent to the wall 48 and in the opposite direction after the sector has been spaced from the wall 48.

The apparatus 31 is completed by a pair of clamps 87 and by a pair of pads 88. The clamps 87 have a reciprocating vertical motion between a raised position (see FIG. 2), in which they grip the films 34, 35 directly below the oscillating plates 43, 44, and a lowered position, in which they release the films after a stroke which determines the length of the package.

Likewise, the two pads 88 are arranged in front of the wall 48 and actuated with a reciprocating motion between a position in which they are spaced from the wall and a position in which they abut thereon.

In the spaced position, the pads 88 allow the films 34, 35 to pass between them and the wall 48 when the films 34, 35 are drawn downward by the clamps 87. In the abutment position, the pads 88 lock only the film 34, allowing to form the enclosure and to center the sheet 4 with respect to the sheet 3.

It should be noted that the clamps 87 are arranged and spaced with respect to each other so that they can grip both films in the overlap region. Vice versa, the pads 88 have a mutual distance which is greater than the width of the sheet 35 and such that in the position for abutting on the surface 48 the pads 88 can act on the borders 7 and 8 and lock the sheet 3 alone against the wall 48.

Downstream of the preparation apparatus 31 there is a carousel 89, on which the packaging of the product is completed.

The carousel 89 can rotate about an horizontal axis 90 which is parallel to the shaft 47 and comprises a structure which is per se known in packaging technology and whose key elements are a plurality of grip elements or clamps 91, which are angularly equidistant and are each composed of a fixed jaw 92 and a movable jaw 93 which is controlled, by means of a cam follower 94, by a central cam 95. Two folding units 96 are associated with the fixed jaw 92 and are adapted to fold onto the opposite ends of the product the lateral portions of the lateral borders 7 and 8 and to maintain the stacked arrangement of the biscuits that constitute the product.

Every time the carousel 89 stops, the grip element 91 is in the open position, opposite the apparatus 31, so that the fixed jaw 92 is aligned with the pan 21, so as to allow to insert the product 1 between the jaws 92, 93 and to partially wrap the package 2 around the product. At the same time, an additional grip element 91 is at the top of the carousel in order to allow the longitudinal closure of the enclosure by means of two heat-sealing units 97 which are actuated so as to clamp the transverse borders 9 and 10 between them and heat-seal them, thus forming the wing 11.

The operation of the machine is described hereinafter by following the steps of the packaging of an individual product 1 and assuming the initial position of FIG. 2, in which the product 1 has been transferred by the conveyor 12 onto the pan 21, ready to be made advance by the pusher 22, and the clamps 87 are in the raised position, ready to grip the lower edge of the films 34, 35 cut earlier by the blade 64 in cooperation with the edge 65.

In this situation, the toothed sector 76 is spaced from the wall 48, and the roller 58, arranged between the films 34 and 35, lies below the roller 38, so that it does not divert the path of the undulated film 35.

Figure 7:
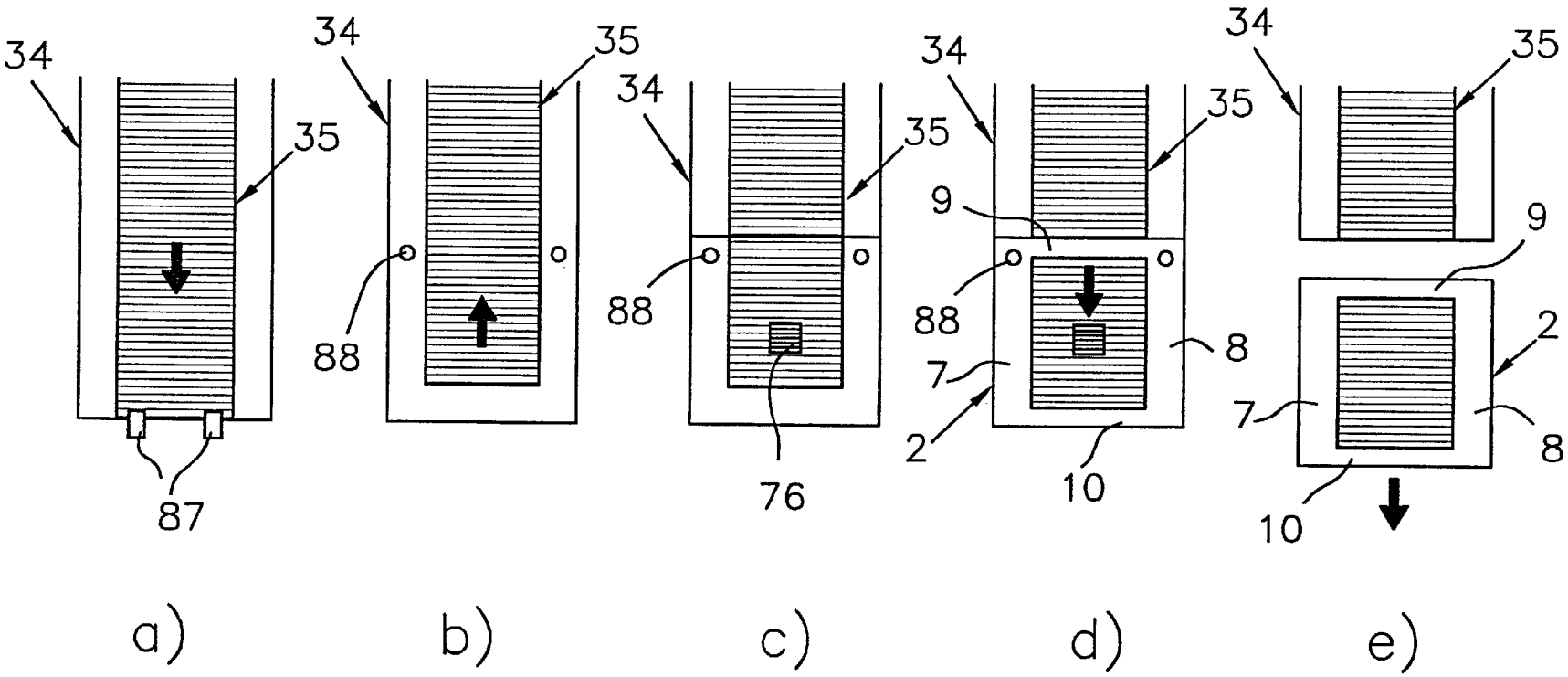
FIG. 7 is a view of the operating method of the centering apparatus.

By lowering the clamps 87 with a preset stroke, two portions of film 34, 35 are unwound from the reels 32, 33, their length being equal to the length of the package 2 (FIG. 7*a*).

After the clamps 87 have stopped at the lower stroke limit, the plates 43, 44 are made to oscillate so as to move the films 34, 35 into contact with the wall 48, and the pads 88 are actuated; by acting on the lateral borders of the outer film 34, said pads lock it against the wall 48 but leave the inner film 35 free.

At this point the clamps 87 are opened and the lever 50 is actuated; together with the arm 53, the traction element 54, and the brackets 56, the lever causes the oscillation of the roller 58 under the roller 37, forcing the film 35 to follow a zigzag path and thus gathering upward (i.e., in the opposite direction with respect to B) a certain extent of the film 35, so as to leave exposed the lower border of the film 34 (FIG. 7*b*).

At this point, in step with the blade 64 actuated by the lever 51 by means of the traction element 67 and the arm 68, the hollow shaft 69 is turned and the arm 74 is made to oscillate toward the block 49, so as to move the toothed sector 76 into the position for clamping the films 34, 35 against the wall 48 of the block 49 and for the meshing of the teeth of the sector with the undulations of the film 35.

As soon as the films 34, 35 have been locked, the blade 64 is actuated and, by cutting the films 34, 35 under the plates 43, 44, crops the two sheets 3, 4 that compose the package 2 (FIG. 7*c*).

In step with the cutting of the films, also the lever 82 is actuated and, by means of the traction element 81 and the lever 79, causes the rotation of the inner shaft 72. The rotation of the shaft 72, by means of the pulleys 73, 77 and the belt 78, is transmitted to the sector 76 which, by rotating in the direction D, draws downward the sheet 4 by an extent equal to half the extent previously gathered upward by way of the movement of the roller 58.

In this manner, the sheet 4 remains centered on the sheet 3, forming a package 2 in which the upper border 9 and the lower border 10 and the lateral borders 7, 8 of the sheet 3 are left exposed by the sheet 4 (FIG. 7*d*).

Once the formation of the package 2 has been completed, the pusher 22 and the pan 21 of the transfer unit 17 are actuated in the direction A. When the front edge of the pan 21 is arranged adjacent to the package 2, by continuing the stroke of the pusher 22 the product 1 is transferred between the jaws 92, 93 of the clamp 91, which are standing by in the open condition (FIG. 7*e*).

By way of the thrust applied by the pusher 22 and of the abutment of the front edges of the jaws 92, 93, the package is folded in a U-like shape around the product, while the central portions of the lateral borders 7, 8 are folded onto the opposite heads of the product by the lateral folding units 96 (see FIG. 1).

The clamp 91 is then closed and the carousel 86 is turned through an angular extent in order to place a new clamp in the position for receiving a new product.

When the clamp with the product has reached the top of the carousel, the heat-sealing units 97 join the transverse borders 9, 10 so as to provide a wing 11.

By using known methods which as such are not illustrated in detail, the central portions of the lateral borders 7, 8 folded by the lateral folding units 96 are then reopened so as to form a tubular enclosure, which is closed at its opposite ends with diametrical heat-sealing lines 98 (see FIG. 1) which form triangular lugs 99. Appropriate folding units then fold the lugs 99 and the wing 11 onto the opposite heads and onto the outer surface of the products, thus providing a substantially cylindrical package.

It is evident that the apparatus allows to achieve the intended aim and object. In particular, the longitudinal closure of the enclosure is achieved by releasing two borders of the heat-sealable outer sheet from the paper-like inner sheet and clamping said borders without applying the heat-sealing pressure to the product and therefore without compromising the integrity of the product.

It should be noted that the mutually opposite arrangement of the upper and lower borders 9 and 10 and the uniformity of the thickness of said borders allows the heat-sealing units 87 to apply a uniform pressure and thus provide a perfect heat-sealing line along the entire length of the wing 11. The heat-sealing line, by intersecting the diametrical heat-sealing lines 98, ensures an absolutely hermetic closure of the package.

A substantial advantage of the apparatus is its flexibility in use and its limited dimensions, which allow to apply it in conventional machines with horizontal and vertical package film unwinding.

The machine can be easily adapted to various product formats by acting on the stroke of the clamps 87 in order to adjust the length of the package. The consequent adjustment of the centering movement of the paper sheet with respect to the heat-sealable sheet is achieved by adjusting the rotation of the sector 76 by shifting the position of the articulation between the traction element 81 and the arm 79 along the slot 80.

The machine is susceptible of numerous modifications and variations, all of which are within the scope of the same inventive concept. In particular, the outer sheet 3 can be retained by providing, on the face 48 of the block 49, a plurality of ports connected to a vacuum source instead of by using the pads 88.

The disclosures in Italian Patent Application No. BO2000A000483, from which this application claims priority, are incorporated herein by reference.

What is claimed is:

1. A method for manufacturing a package for packaging food products composed of an outer sheet made of heat-sealable material and of an inner sheet which has a smooth face in contact with said outer sheet and an undulated face, said sheets being cut from two respective outer and inner films unwound from reels, said outer film being wider than said inner film transversely to the unwinding direction, said method comprising the steps of:

coupling said inner film to said outer film so as to form two lateral borders of said outer film left exposed by said inner film;

unwinding a length of said films from said reels;

making one film slide with respect to the other, parallel to said lateral borders, up to a staggered position, in which said inner film leaves exposed an end portion of said outer film which has a preset height and is perpendicular to said lateral borders;

cropping both films in said staggered position, so as to form said outer and inner sheets having two borders which are superimposed and two borders in which the inner sheet border leaves exposed said end portion of said outer film;

moving one sheet with respect to the other by an extent which is smaller than the height of said end portion, so as to form a package in which the inner sheet is centered on the outer sheet, so as to form two transverse borders which are not as high as said end portion.

2. The method according to claim 1, wherein after unwinding said length of said films from said reels, it comprises the steps of:

locking the outer film and longitudinally staggering, in the opposite direction with respect to the unwinding direction, the inner film with respect to the outer film, so as to leave exposed on the outer film said transverse end portion having a preset height which is perpendicular to said unwinding direction;

locking both films independently of each other in said staggered position of the inner film with respect to the outer film;

cropping a length of both of said films, so as to form an outer sheet and an inner sheet, the inner sheet being staggered by said end portion with respect to said outer sheet;

keeping said outer sheet locked and moving said inner sheet with respect to said outer sheet in the film unwinding direction by an extent which is smaller than the height of said end portion, so as to form a package in which the outer sheet has, at its opposite ends, two transverse borders which are not as high as said end portion and are not covered by said inner sheet.

3. A method for packaging food products in a package manufactured according to claim 2, comprising the steps of:

positioning said package in front of a product to be packaged so that it lies on a plane which is substantially perpendicular to the advancement direction of said product;

pushing said product against said package and folding it so that said exposed transverse borders face each other;

mutually joining said exposed borders so as to form a tubular enclosure which is closed around said product.

4. An apparatus for performing the method according to claim 2, comprising:

clamp means adapted to grip the mated ends of said films and actuated with a reciprocating motion between a position for gripping said ends and a position for releasing them, so as to unwind a portion of said films from said reels;

means for staggering, in said position for releasing said films, one film with respect to the other, so as to leave exposed an end portion having a preset height which is transverse and perpendicular to said lateral borders;

means for locking both films in said position in which the inner film is staggered with respect to the outer film;

means for cropping a length of both of said films so as to form an outer sheet and an inner sheet, the inner sheet being staggered by said end portion with respect to said outer sheet;

means for moving one of said sheets with respect to the other sheet by an extent which is smaller than the height of said end portion, so as to form a package in which the outer sheet has, at its opposite ends, two transverse borders which are not as high as said end portion and are not covered by said inner sheet.

5. The apparatus according to claim 4, wherein said outer film locking means are constituted by a block, which forms a wall which is substantially parallel and adjacent to said outer film, and by two pads arranged so as to act on said lateral borders of said outer sheet in order to lock them against said wall.

6. The apparatus according to claim 4, wherein said means for staggering said inner film with respect to said outer film comprise two fixed rollers arranged on one side of said inner film and a movable roller arranged on the opposite side of said inner film, said movable roller being actuated so as to engage between the rollers of said pair in order to divert said inner film along a zigzag path which is adapted to form said exposed end portion on said outer film.

7. The apparatus according to claim 4, wherein said means for moving one of said sheets with respect to the other comprise an arm which is mounted radially on a shaft actuated with an oscillating motion, a toothed sector which is rotatably supported at the end of said arm, transmission means for imparting a rotary motion to said sector, said shaft being controlled by first cam-type actuation means so as to oscillate between a position in which said sector engages the undulated face of said inner sheet and a position in which it is disengaged from said face, said transmission means being controlled by second cam-type elements which are adapted to produce an angular rotation of said sector in said engagement position so as to cause the movement of said inner sheet with respect to said outer sheet by said extent.

8. The device according to claim 7, wherein said transmission means comprise a first toothed pulley which is keyed on a keying pivot of said toothed sector, a second toothed pulley which is keyed, on a shaft supported coaxially with respect to the rotation axis of said arm, and a toothed belt which is closed in a loop around said pulleys, an additional arm being radially rigidly coupled to said shaft, an element for connection to said cam-type elements being fixable along said arm so as to allow to adjust the rotation angle of said sector.

9. The device according to claim 4, wherein said cropping means comprise an oscillating blade that cooperates in a scissor-like fashion with an edge formed on said block.

10. The device according to claim 4, wherein the device is interposed between a pusher element and a rotating carousel which are actuated intermittently, said carousel being provided with a plurality of grip elements consisting of clamps which are angularly distributed along a circumference and are composed of a fixed jaw and a movable jaw controlled by an actuation cam, said grip elements being adapted to assume in succession a position for receiving the products transferred by said pusher between said jaws in the condition in which the carousel is stopped, said jaws being adapted to fold said package around said product so that said exposed borders face each other, means being further provided for heat-sealing together said exposed borders so as to form a closed tubular enclosure around said product.

* * * * *